United States Patent [19]

Buchla

[11] Patent Number: 4,628,786

[45] Date of Patent: Dec. 16, 1986

[54] VELOCITY RESPONSIVE MUSICAL INSTRUMENT KEYBOARD

[75] Inventor: Donald F. Buchla, Berkeley, Calif.

[73] Assignee: Kimball International, Inc., Jasper, Ind.

[21] Appl. No.: 746,245

[22] Filed: Jun. 18, 1985

Related U.S. Application Data

[63] Continuation-in-part of Ser. No. 577,854, Feb. 7, 1984, Pat. No. 4,558,623.

[51] Int. Cl.[4] ..... G10H 1/34

[52] U.S. Cl. ..... 84/1.1; 84/1.27; 84/DIG. 7

[58] Field of Search ..... 84/1.09, 1.1, 1.27, 84/DIG. 7

[56] References Cited

U.S. PATENT DOCUMENTS

| | | | |
|---|---|---|---|
| 3,507,970 | 4/1970 | Jones | 84/1.01 |
| 3,634,593 | 1/1972 | Nagano | 84/1.01 |
| 3,715,447 | 2/1973 | Ohno | 84/1.24 |
| 3,836,909 | 9/1974 | Cockerell | 340/365 C |
| 3,902,397 | 9/1975 | Morez et al. | 84/1.27 |
| 3,927,593 | 12/1975 | Kawamura | 84/1.01 |
| 3,943,812 | 3/1976 | Nagai et al. | 84/1.1 |
| 4,027,569 | 6/1977 | Luce et al. | 84/1.1 |
| 4,033,219 | 7/1977 | Deutsch | 84/1.03 |
| 4,213,367 | 7/1980 | Moog | 84/1.22 |
| 4,416,178 | 11/1983 | Ishida | 84/1.19 |
| 4,520,706 | 6/1985 | Deforeit | 84/1.1 |
| 4,528,885 | 7/1985 | Chihana | 84/1.1 |

*Primary Examiner*—S. J. Witkowski

*Attorney, Agent, or Firm*—Jeffers, Irish & Hoffman

[57] ABSTRACT

A keyboard system in a keyboard controlled musical instrument includes a pair of spaced apart electrode members and a pickup movable in the space intermediate the electrode members. Respective voltages are impressed on the electrodes to establish an electric field therebetween and the voltage impressed on the movable pickup is a function of its position relative to the two electrodes. The pickup is actuated by the playing key which contacts a resilient, yieldable stop. The force with which the playing key is depressed is measured by sensing when the key is fully depressed, initiating a count at that point and counting a predetermined period. At the end of the predetermined period the voltage on the pickup is detected which gives an indication of the amount of overtravel of the key beyond its normal depressed position. This detected voltage is used to alter the quality of the tones produced by the musical instrument.

10 Claims, 6 Drawing Figures

VELOCITY RESPONSIVE MUSICAL INSTRUMENT KEYBOARD

CROSS-REFERENCE TO RELATED APPLICATIONS

This is a continuation-in-part of application Ser. No. 577,854 filed Feb. 7, 1984, and now U.S. Pat. No. 4,558,623 which application is incorporated herein by reference.

BACKGROUND OF THE INVENTION

The present invention relates to a touch responsive arrangement for a keyboard controlled electronic musical instrument and more particularly to an apparatus and method for sensing the force with which a key has been struck.

In many prior art electronic keyboard musical instruments, such as electronic organs, pianos, synthesizers and the like, when a playing key is depressed or struck, an electric switch will be closed to indicate to the electronic circuitry that a key has been depressed. It is often desirable in instruments of this type to detect the force with which a key is depressed because the musician, by depressing a key not only selects the particular note to be played by the instrument but also controls the amplitude with which the note is to be played as well as many other musical effects which he may want to create. In many of the prior art electronic pianos, when a key is depressed, a contact member is disconnected from one bus and is then brought into contact with a second bus on full key depression. The time of travel of the contact between the two busses is measured to arrive at a measure of key velocity and the amplitude of the tone is altered in accordance therewith.

In these prior art systems, the force with which the keys are struck is measured as a function of the travel time of the contact from the time that the key is first actuated to the time that the key actuates the note being played. There are several disadvantages to these velocity measuring types of systems. First of all the switch contacts tend to become dirty after a period of time thereby causing extroneous signals and intermittent operation. Secondly there is a problem of switch bounce which is particularly troublesome in digital instruments because digital circuitry detects the switch bounce as repeated key closures whereas only one key closure is intended. Bounce must therefore be overcome by utilizing special switch debouncing circuitry.

Switch contacts can also become deformed so that different switches will close at different points in the depression of their respective keys. In velocity sensitive keyboards, such as those used in electronic pianos, inconsistencies in switch closure times will result with some keys producing tones of different amplitudes for a given key depression velocity, thereby resulting in non-uniform operation.

An additional problem encountered in prior art electronic keyboard instruments is that if a musician does not fully release a key but performs a rapid trill on a particular key by keeping his finger in touch with the key and rapidly successively operating the key a number of times, the prior art timing circuits may never be actuated because timing is generally initiated at the moment the key is first depressed from a released position. Therefore, if the key is not depressed from a key released position, the keyboard key velocity detecting circuitry will not be actuated and no output will be generated by this type of playing. It is therefore desired to provide an electronic musical keyboard instrument wherein the detecting mechanism is sensitive not only to normal playing of the keys but is sensitive to playing of the keys without an actual release of the keys between key actuations.

Another problem with many prior art electronic keyboards has been that uniform and predictable aftertouch control is particularly difficult to achieve when utilizing compressible resistive strips or piezoelectric elements, because their electric characteristics may vary with time, temperature and use. Furthermore electrical changes resulting from physical changes in the element, such as in the case of the amount of compression of a resistive strip, is difficult to predict and control with the consistency that is desirable.

The prior art art keyboard system described in the aforementioned patent, U.S. Pat. No. 4,558,623, comprises a moveable pickup that is positioned within an electrostatic field between two stationary electrodes, and the relative positioning of the moveable electrode within the field produces a variable output voltage. The pickup is moved by depression of the key, and the velocity with which the key is struck is detected by timing the movement of the pickup from the undepressed position to a fully depressed position but before overtravel. Again, a timing technique is used to measure key velocity rather than the terminal velocity of the key, which is more like the action in a conventional acoustic piano. Full release of the key is often necessary before the timing sequence can be activated, so that trills and other rapid playing effects may result in missed notes.

SUMMARY OF THE INVENTION

The keyboard system for an electronic musical instrument of the present invention, in accordance with a preferred embodiment thereof, overcomes the problem and disadvantages of prior art keyboards by providing a pickup for each key that is moved within an electric field formed between a pair of stationary electrodes. The pickup never contacts either of the electrodes, but the voltage impressed on the pickup will vary as a function of the position of the pickup within the electric field. Accordingly, as the key is depressed and the pickup is moved within the field, the voltage that is impressed thereon changes with the position of the key, and threshold detectors and other detection circuits can be utilized to detect when the key has reached critical points in its range of travel, such as its fully depressed position, and the amount of aftertouch movement of the key. For purposes of this application, the "key" includes not only that portion actually contacted by the performer, but the entire mechanical linkage.

A yieldable stop member for each key limits the downward movement of the key and the position of the key, when it engages the stop member, is detected by the processing circuitry to indicate to a microcomputer, for example, that the key has been fully depressed. The force with which the key has been struck or depressed causes the key to overtravel and compress the resilient stop member to a certain degree and the amount of overtravel is measured by the voltage impressed on the pickup member at the end of a predetermined amount of time which starts when the key is fully depressed. The detection circuitry detects when the key is first fully depressed by sensing when the voltage on the pickup member reaches zero. Then a count on a clock is initiated or a predetermined number of scans of the keyboard are counted, and, after a predetermined count has been reached, the voltage is again measured on the pickup member. The level of voltage on the pickup member is an indication of the force with which the key has been struck or depressed. Therefore the present keyboard assembly measures the amount of overtravel of the key from its fully depressed position into the resilient stop member as an indication of the force with which the key is struck. The detected voltage which is an indication of the force with which the key is struck is used to alter the quality of the generated tone. For example, the vibrato, pitch deviation or loudness could be altered in a continuous fashion as a function of the amount of overtravel of the key.

In the disclosed embodiment of the invention, AC voltages of equal amplitude but opposite phase are impressed on the two electrodes so that the electric field generated between the electrodes varies as a function of the distance between the electrodes so that, at a certain spacing from the electrodes, the electric field will have zero amplitude due to the cancellation effect of the out of phase voltages. The initial voltage on the pickup, before actuation of the key, is of one polarity as the pickup is located adjacent the first electrode. The system is adjusted so that depression of the key to its fully depressed position, but before it reaches the aftertouch range, positions the pickup to the point of electric field zero amplitude, thereby providing an easily detectable reference point for full key depression. Further movement of the pickup past the point of zero amplitude moves it into an area of opposite voltage polarity due to the approach of the pickup to the second electrode, and the magnitude of this voltage indicates the amount of force with which the key is struck against a resilient stop and moves into the aftertouch range.

An advantage of the keyboard assembly according to the present invention is that the musician can operate the keys very rapidly in the manner of a trill and still cause the system to detect that the keys are being actuated even though the keys never return to their undepressed positions.

A further advantage of the system according to the present invention is that the key actuation detection assembly is not subject to contamination and the degradation of performance thereby.

Another advantage of the present system is that it is not subject contact bounce. A still further advantage of the present invention is that the pickup system is not affected by physical changes in the operating elements due to time, temperature and use.

The invention comprises, in one form thereof, an assembly for detecting the force with which a key of a keyboard musical instrument is depressed. The assembly includes first and second stationary electrodes and means connected to the first and second electrodes for establishing respective first and second voltages thereon to establish an electric field between the eleotrodes. A playing key is provided and a movable electrode positioned intermediate the first and second electrodes is movable from the first electrode toward the second electrode in response to depression of the key. The voltage impressed on the movable electrode is a function of its position relative to the first and second electrodes. Means is connected to the movable electrode for detecting when the key is fully depressed and a timing means is actuated by the detecting means when the key is fully depressed for timing a predetermined period. Means connected to the movable electrode to the timing means detects the impressed voltage on the movable electrode at the end of the predetermined period, and a system is provided for controlling the quality of the tones produced by the instrument in response to the detected voltage.

The invention, in one form thereof, comprises a keyboard system in a keyboard controlled musical instrument including a pair of spaced apart electrode members. Means is provided for impressing respective sinusoidal voltages on each of the electrodes for establishing an electric field between the electrodes which varies as a function of the distance from the first of the electrode members toward the second of the electrode members. The voltages are of equal amplitude but of opposite phase. A movable pickup is positioned in the electric field between the electrode members and is spaced therefrom. The pickup has a voltage impressed thereon by the electric field which is a function of the distance of the pickup means from the first electrode member. A depressible playing key is provided and means is provided for connecting the playing key to the pickup to move the pickup means within the field toward or away from the first electrode member in accordance with the depression of the key. Means is connected to the pickup for sensing the voltage impressed thereon and clock means is connected to the voltage sensing means for initiating a count when the voltage sensing means senses that the key is fully depressed. Means is connected to the voltage sensing means for controlling the quality of tones produced by the musical instrument in response to the amplitude of the detected voltage at the end of a predetermined count.

The invention, in one form thereof, still further provides a method for detecting the force with which a keyboard musical instrument playing key is depressed. The musical instrument includes a depressible key, first and second spaced apart electrodes, a movable pickup located in the space between the electrodes and operable by the key to move away from the first electrode and toward the second electrode. A clock means is also provided. The method comprises establishing an electric field between the electrodes which varies as a function of the distance from the first to the second electrode, depressing the key, initiating a predetermined count on the clock when the key is fully depressed, causing the key to overtravel against a resilient stop and at the end of the predetermined count measuring the voltage on the pickup.

It is an object of the present invention to provide a keyboard system for an electronic musical instrument utilizing a pickup which does not make direct electrical contact with stationary electrodes.

It is a further object of the present invention to provide a keyboard system which is sensitive to the force which the keys are struck and which includes an aftertouch control for modifying the quality of the tones in accordance with the amount of overtravel of the keys.

A still further object of the present invention is to provide a pressure sensitive keyboard for a musical instrument that is inexpensive yet it is reliable in operation.

DETAILED DESCRIPTION OF THE PREFERRED EMBODIMENT

Figure 1:
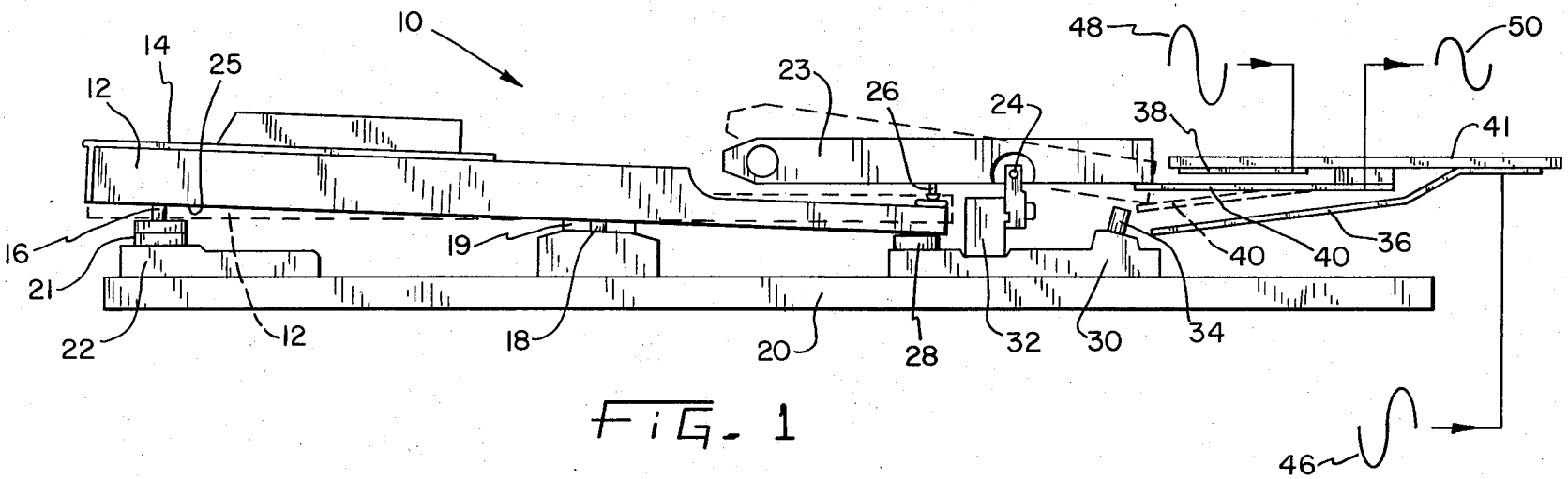
FIG. 1 is a sectional, side elevational view of the keyboard showing a key in its rest position in solid lines and in its normally depressed position in dotted outline.
Figure 3:
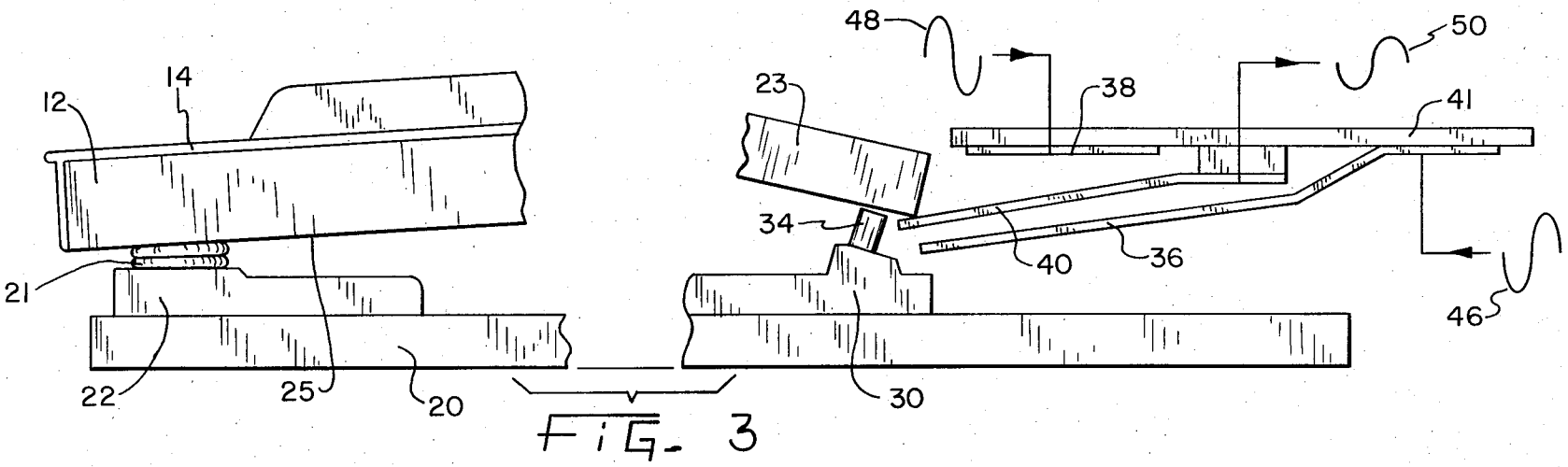
FIG. 3 is a view similar to FIG. 2 wherein the key has been depressed past its fully depressed position into an overtravel position.

Referring to FIG. 1, a keyboard 10, in a preferred embodiment of the invention, comprises a plurality of playing keys 10, only one of which is shown, and which are linearly arranged in the usual fashion as in a piano or organ keyboard. The keys are made of wood or plastic, for example, and are supported on a base 20. A pair of pins 16 and 18 are provided and are secured to base 20 to serve as a guide and pivot pin, respectively, for playing key 12. Pin 18 is provided with a felt or foam rubber washer 19 which is disposed around pin 18 and serves as the fulcrum point for key 12. Pin 16 is secured to a stop member 22 and has circumferentially disposed thereon a pair of resilient washers 21, constructed of a yieldable compressible material and positioned so that the lower surface of key 12 contacts and compresses washers 21 when key 12 is depressed by the musician past its normal fully depressed position. Washers 21 are preferably made of a resilient material such as Poron, however any suitable resilient material may be used. Since washers 21 are compressible, key 12 can be depressed past its normal fully depressed position where its bottom surface 25 just touches washers 21 to compress washers 21 as illustrated in FIG. 3. Resilient washers 21 will therefore be compressed to a greater or lesser extent depending upon the amount of force with which key 12 is struck.

The rearward end of key 12 includes an actuating pin 26 for pivoting an actuator 23 as the key is struck. Actuator 23 is supported on a pivot pin 24 for pivoting movement thereabout. A rest stop 28 is provided for the rearward end of key 12 for normally supporting key 12 in its undepressed rest position. Rest stop 28 is supported on support member 30 which also supports a mounting assembly 32 on which actuating pin 24 is mounted. Support member 30 also supports a resilient actuator stop member 34. Therefore, when key 12 is depressed it will move from the position wherein it rests on stop 28 to cause actuator 23, under the movement of actuating pin 26 to pivot about pin 24. Stop member 34 limits the pivoting movement of actuator 23.

An electrical insulating member 41, such as a printed circuit board, is provided as a base for supporting three electrodes 36, 38 and 40. Electrodes 36 and 38 are stationary but pickup electrode 40 is movable from a rest position wherein it is located adjacent stationary electrode 38 to an actuated position wherein it is located adjacent stationary electrode 36. Moveable pickup electrode 40 is actuated by actuator 23 to move downwardly from its position adjacent stationary electrode 38 toward stationary electrode 36. Key 12, actuator 23 and pickup 40 are shown in their actuated position in dashed lines (FIG. 1) wherein pickup 40 has been moved toward stationary electrode 36.

A sinusoidal alternating voltage 46 is applied to stationary electrode 36 and a sinusoidal voltage 48, equal an amplitude to signal 46 but opposite in phase thereto, is applied to stationary electrode 38. The two alternating sinusoidal voltages 46 and 48 generate an electric field between electrodes 38 and 36 which varies as a function of the distance relative to electrodes 36 and 38. Movable electrode 40 will be impressed with a voltage which is a function of its position relative to electrodes 36 and 38. Thus by detecting the voltage on movable electrode or pickup 40 its position intermediate the stationary electrode can be detected and the amount of overtravel of key 12 beyond its fully depressed position can be detected. The amount of overtravel is a function of the force with which the key is depressed.

Figure 2:
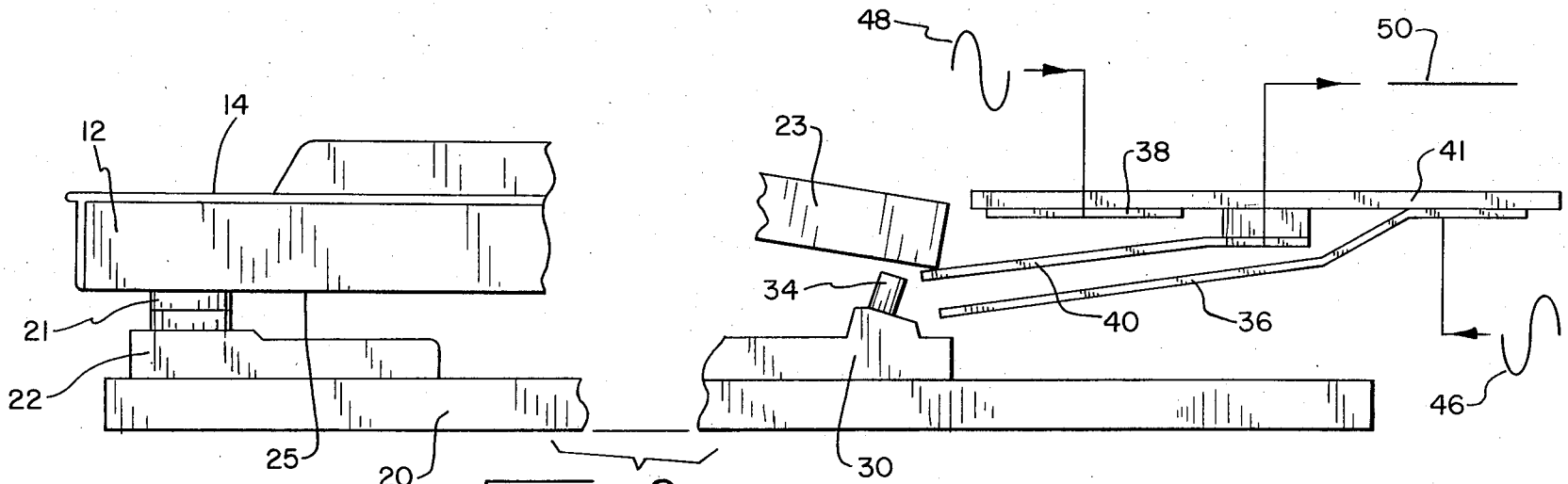
FIG. 2 is an enlarged sectional, fragmentary view similar to FIG. 1 wherein the key has been depressed past its rest position into its normal fully depressed position.

Referring now to FIGS. 1, 2 and 3, key 12 is shown in various positions. In the rest position indicated in FIG. 1, shown in solid lines, the voltage impressed upon pickup member 40 is shown as waveshape 50. This waveshape is similar to signal 48 impressed on stationary electrode 38 but slightly smaller in amplitude.

However, in FIG. 2 when key 12 is in its fully depressed position and just touches resilient stop member 21, actuator 23 causes pickup 40 to be moved to the position indicated, wherein the voltage impressed on pickup 40 is zero as indicated by waveform 50. Because of the alternating nature of impressed signals 46 and 48 and because these signals are out of phase, the signals will just cancel at a certain point intermediate electrodes 36 and 38. The system is adjusted and conditioned such that this cancelling point in the electric field coincides with the fully depressed condition of key 12 where yieldable members 21 are just touched, but not depressed, by key 12.

FIG. 3 indicates the key condition when the key is depressed more forcefully and when yieldable member 21 has been compressed so that the key is in its overtravel or aftertouch position. The waveform 50 of the signal impressed on pickup member 40 has now increased from zero amplitude to be of the same phase as signal 46 but smaller in amplitude. As pickup member 40 moves even closer to electrode 36 due to a greater force with which the key 12 is struck the amplitude of the waveform of the signal on pickup 40 will increase even more.

Figure 4:
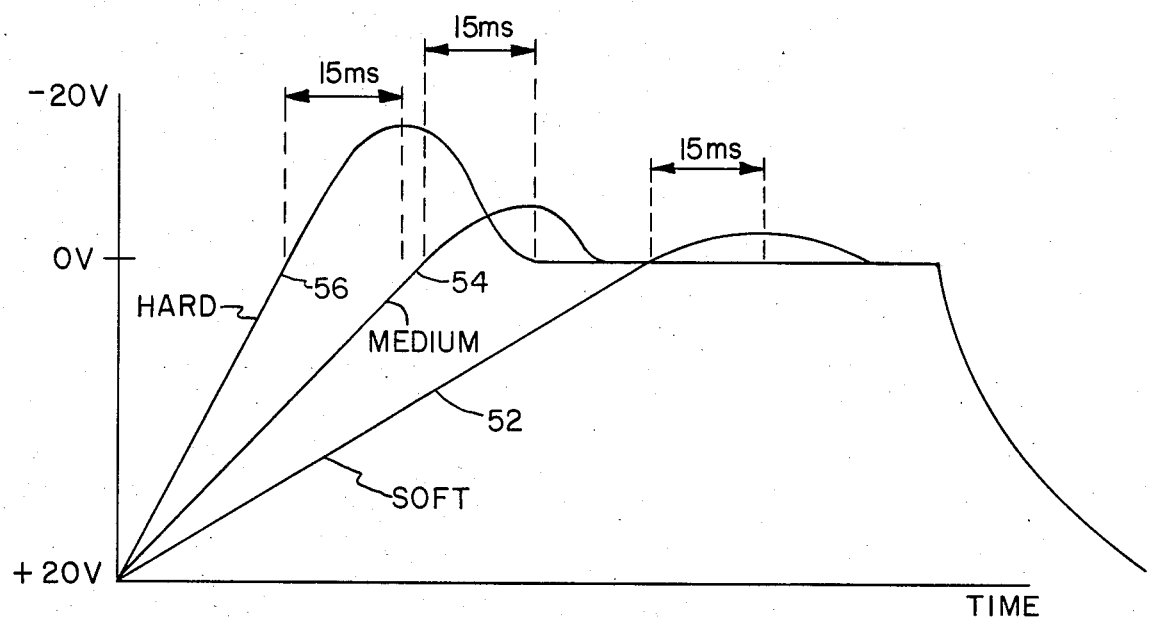
FIG. 4 is a graph including three curves indicating the voltage on the pickup member as a function of time in response to the depression of the key at three different key depression force levels.

Since the actuation of key 12 is dynamic, the voltage 50 on pickup 40 changes as a function of time. This is illustrated in FIG. 4 wherein three curves 52, 54 and 56 are shown indicating the peak voltage of the first half cycle on pickup 40 as a function of time. The abscissa of FIG. 4 shows the elapsed time from the point in time at which the key is depressed. The ordinate shows the peak first half cycle voltage impressed on pickup 40. Thus, when key 12 is struck softly, the voltage on pickup 40 varies as shown by graph 52. If the key 12 is struck forcibly the voltage variation on pickup 40 as a function of time is shown as graph 56. Intermediate striking forces would result in curves located intermediate curves 52 and 56. One medium force curve is shown as curve 54. Thus it can be seen that if the voltage on pickup 40 is measured from the point at which the impressed voltage on pickup 40 is exactly zero, which coincides with the fully depressed position of key 12 as shown in FIG. 2, and if the voltage is then measured a fixed amount of time thereafter, which is a measure of the penetration of key 10 into resilient stop member 21, the magnitude of the impressed voltage provides an indication of the amount of overtravel of the key or force with which the key has been depressed. The predetermined amount of time used for measuring the voltage on pickup has been chosen to be 15 milliseconds in the preferred embodiment, but different amounts of time may be selected. Thus it can be seen that when the key is struck hard the impressed voltage on pickup 40, after the elapsed fixed period of 15 milliseconds, is greater than when the key is struck softly because penetration into stop 21 will be greater. The predetermined period for using the voltage on pickup 40 should be short enough so that the voltage has not decayed after reaching its peak valve due to rebounding of the key.

Figure 5:
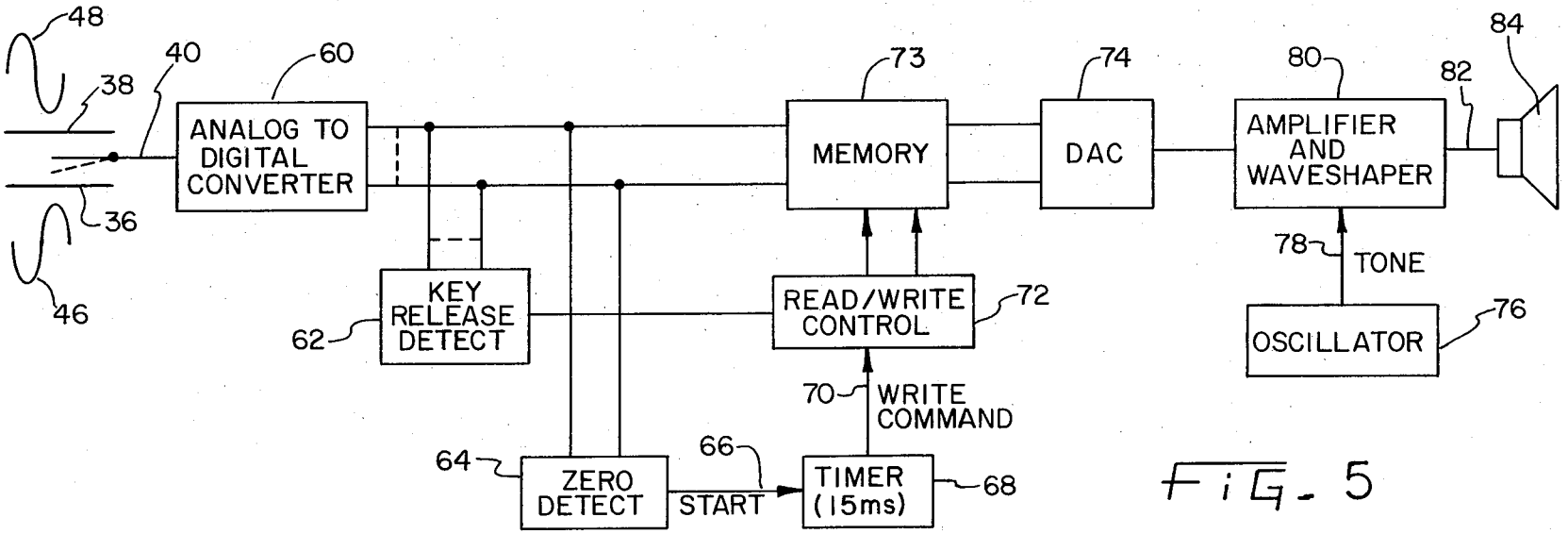
FIG. 5 is a block diagram of an exemplary system for detecting and processing the key pickup data for one key.

Referring now to FIG. 5, a block diagram is shown for a circuit which is used to detect the voltage on pickup member 40 a fixed amount of time after the key has passed its fully depressed position. It should be understood that this circuit is general in nature and that other circuits could be arranged to perform this function. An analog to digital converter 60 is connected to pickup 40 and detects the peak first half cycle voltage then converts the voltage to a digital signal. A key release detect circuit 62 detects when the key is first released by detecting a change in the output voltage of analog to digital converter 60. The key release detect circuit could take any one of a number of different forms, such as a comparator which compares the value of the digital number on the output of converter 60 on successive scans to detect a decreasing output indicative of key release. Alternatively, it could be responsive to the binary number corresponding to full key release.

A zero detect circuit 64 detects when the output of analog to digital converter 60 reaches zero, which is the point at which the key is fully depressed when the bottom surface 25 of key 12 just touches yieldable members 21. Zero detect circuit 64 provides an output on line 66 start timer or clock 68, and the timer will then count a predetermined period of time such as for instance 15 milliseconds or another suitable amount of time as desired. Timer 68 could either be a real time counter which counts absolute time or, alternatively, it could be a circuit which counts a predetermined number of scans of the keyboard in a multiplexed system such as that described in the aforementioned U.S. Pat. No. 4,558,623. Any device for establishing a reference time may be employed. Timer 68 will provide a write command at the end of the timed period on line 70 as an input to read/write control 72. Read/write control 72 will then provide an input to a memory 73 causing it to store the voltage output of analog to digital converter 60 in the appropriate memory location for that key. This voltage provides an indicator of the force with which key 12 has been depressed as explained hereinabove. This information is then routed to a digital to analog converter 74 which provides an output to amplifier and waveshaper 80. Amplifier and waveshaper 80 also receives an input on line 78 from tone generator or oscillator 76. Amplifier and waveshaper 80 will vary the quality of the tones provided to it by oscillator 76 in accordance with the voltage recorded in memory 73 which is an indication of the force with which key 12 has been depressed. The information indicating the force with which key 12 has been struck may be used to alter the quality of the tones in a variety of ways, such as for instance by varying loudness proportional with key velocity by means of a voltage controlled amplifier. The output from amplifier and waveshaper 80 is fed on output line 82 to speaker 84.

The circuit of FIG. 5 discloses the data processing circuit for only a single key, but a multiplexed system such as shown in the aforementioned U.S. Pat. No. 4,558,623 can process the information received from the entire keyboard.

Figure 6:
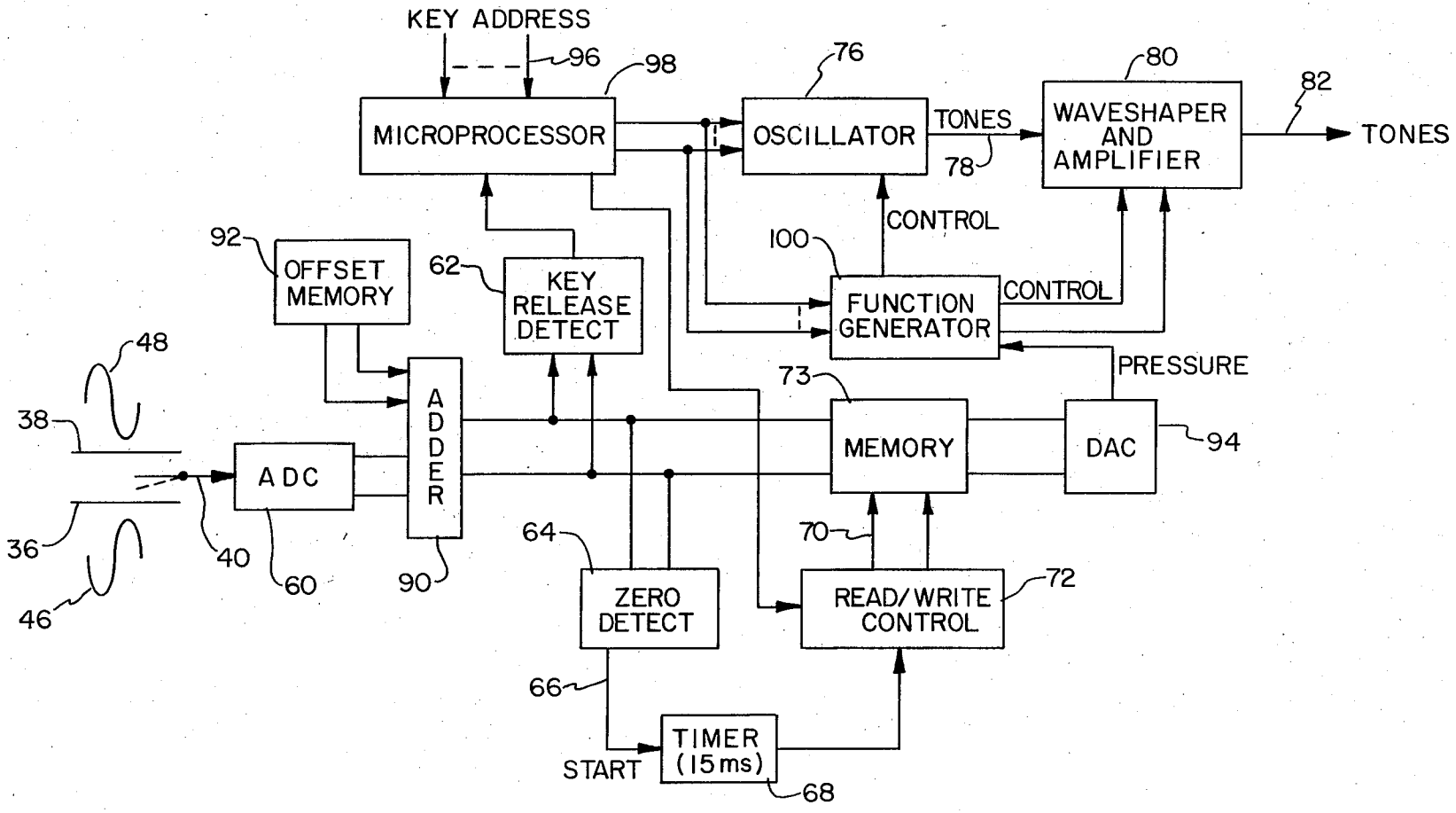
FIG. 6 is a block diagram of another system for processing the keyboard data.

FIG. 6 illustrates another environment for the invention. A pickup 40 again provides an input for analog to digital converter 60. Analog to digital converter 60 provides an input to adder 90 which also receives an input from offset memory 92. Offset memory 92 stores an offset value which provides a certain amount of bias so that key 12, when it reaches the fully depressed position, will normalize the converted output of pickup 40 to provide a zero amplitude digital output. Since keys 12 and pickups 40 may vary somewhat in construction, it is desirable to have an offset memory 92 to calibrate the system.

The calibrated output from adder 90 is provided to a key release detect circuit 62 which in turn provides an input for microprocessor 98. Microprocessor 98 also receives a key address input 96 to indicate which key has been depressed in the multiplexed system. Zero detect circuit 64 provides an input 66 to timer 68 to start the timer as soon as a key 12 reaches its fully depressed condition wherein a zero output, as calibrated by offset memory 92, is indicated at the output of adder 90. Timer 68 provides an input for read/write control 72 which then provides an output 70 to memory 73 after a predetermined amount of time has elapsed. Memory 73 is therefore activated to receive the voltage existing at the output of adder 90 at this point and time which is an indicator of the force with which the key has been depressed as explained hereinabove.

This stored voltage is then fed through a digital to analog converter 94 to control function generator 100. The output of digital to analog converter 94 is indicative of the force with which the keys 12 have been struck. Function generator 100 provides control signals to both the tone oscillator 76 and the waveshaper and amplifier circuit 80 to control the volume and quality of the tones generated by the musical instrument. The microprocessor provides the controlling inputs to oscillator 76 in order to generate the proper tone frequency for the actuated key. The output of waveshaper and amplifier circuit 80 is provided on line 82 for routing to a speaker output system.

Although a specific environment for the keyboard system of the present invention has been shown in FIGS. 5 and 6 other implementations are possible, such as for instance full analog systems utilizing conventional synthesizer technology.

While the invention has been described as having a preferred design it will be understood that it is capable of further modification. This application is therefore intended to cover any variations, used, or adaptations of the invention following the general principles thereof and including such departures from the present disclosure as come within known or customary practice in the art to which this invention pertains and fall within the limits of the appended claims.

What is claimed is:

1. A keyboard system in a keyboard controlled musical instrument comprising:

a pair of spaced apart electrode members;

means for impressing respective alternating voltages on each of said electrodes for establishing an electric field between said electrodes which varies as a function of the distance from the first of said electrode members toward the second of said electrode members, said voltages being of opposite phase;

a movable pickup means positioned in said field between said electrode members and spaced therefrom, said pickup means having a voltage impressed thereon by said field that is a function of the distance of said pickup means from said first electrode member;

a depressible playing key;

means connecting said playing key to said pickup means to move said pickup means within said field toward or away from said first electrode member in accordance with the depression of said key;

means connected to said pickup means for sensing the voltage impressed thereon;

yieldable stop means for limiting the depression of said key to a nominally fully depressed key position, which occurs when said key first touches said stop means, said stop means permitting overtravel of said key past said fully depressed position against a yieldable resistance, the impressed voltage on said moveable pickup means increasing as a function of the amount of overtravel of said key;

clock means connected to said voltage sensing means for initiating a count when said voltage sensing means senses that said key is fully depressed; and means connected to said voltage sensing means for controlling the quality of tones produced by said musical instrument in response to the amplitude of the detected voltage at the end of a predetermined count.

2. The assembly of claim 1 wherein said respective voltages impressed on said electrodes are sinusoidal.

3. The assembly of claim 1 wherein the voltage impressed on said movable pickup means has zero amplitude when said key is fully depressed, said sensing means including threshold means for detecting said zero amplitude voltage.

4. In a keyboard musical instrument, an assembly for detecting the force with which a key is depressed comprising:

a first stationary electrode;

a second stationary electrode;

means connected to said first and second electrodes for establishing respective first and second alternating voltages on said first and second electrodes to establish an electric field therebetween, said voltage being 180° out of phase;

a playing key;

resilient stop means first contacted by said key when said key is nominally fully depressed for yieldably resisting further movement of said key, a movable electrode positioned intermediate said first and second electrodes and movable from said first electrode toward said second electrode in response to the depression of said key, the voltage impressed on said movable electrode being a function of its position relative said first and second electrodes;

means connected to said movable electrode for detecting when said key is nominally fully depressed;

timing means actuated by said detecting means when said key is fully depressed for timing a predetermined period;

means connected to said movable electrode and said timing means for detecting the impressed voltage on said movable electrode at the end of said predetermined period to thereby measure further movement of said key after contacting said resilient stop means; and means connected to said impressed voltage detecting means for controlling the quality of tones produced by said instrument in response to said detected voltage.

5. The assembly of claim 4 wherein said first and second voltages are sinusoidal voltages which are of equal amplitude.

6. The assembly of claim 4 wherein the voltage impressed on said movable electrode has zero amplitude when said key is nominally fully depressed, the impressed voltage detecting means including threshold means for detecting said zero amplitude voltage.

7. The assembly according to claim 4 wherein said stop means permits overtravel of said key past said nominally fully depressed position, the impressed voltage on said movable electrode increasing as a function of the amount of overtravel said key.

8. A method for detecting the force with which a keyboard musical instrument playing key is depressed, said musical instrument including a depressible key, first and second spaced apart electrodes, a movable pickup located in the space between the electrodes and operable by said key to move away from the first electrode and toward the second electrode, and a clock, said method comprising:

impressing alternating voltage of opposite phase on the electrodes to establish an alternating electric field between the electrodes which varies as a function of the distance from the first to the second electrode, the electric field impressing a voltage on the movable pickup;

depressing the key to thereby cause the pickup to move within the electric field and the voltage impressed thereon to vary as a function of position of the pickup in the field;

sensing the voltage on the pickup and initiating a predetermined count on the clock when the key is fully depressed;

continuing to depress the key past the fully depressed position into an overtravel range against a yieldable force, the voltage impressed on the pickup changing as a function of the amount of overtravel of the key; and at the end of the predetermined count, measuring the voltage on the pickup and using the measured voltage to vary a characteristic of a tone produced by the instrument.

9. The method of claim 8 including continuously monitoring the voltage on the pickup as the key is depressed and initiating the clock count when the measured pickup voltage is zero.

10. The method of claim 8 and including the step of controlling the amplitude of the tone produced by the instrument in response to the measured voltage at the end of the predetermined count.

* * * * *

UNITED STATES PATENT AND TRADEMARK OFFICE

CERTIFICATE OF CORRECTION

PATENT NO. : 4,628,786

DATED : December 16, 1986

INVENTOR(S) : Donald F. Buchla

It is certified that error appears in the above-identified patent and that said Letters Patent is hereby corrected as shown below:

Claim 4, Col. 9, line 52, change "voltage" to --voltages--.
Claim 8, Col. 10, line 35, change "voltage" to --voltages--.

Signed and Sealed this

Fourteenth Day of April, 1987

*Attest:*

DONALD J. QUIGG

*Attesting Officer*

*Commissioner of Patents and Trademarks*